United States Patent [19]

MacDonald, Jr.

[11] Patent Number: 4,510,726

[45] Date of Patent: Apr. 16, 1985

[54] INSULATED BUILDING STRUCTURE AND METHOD FOR ASSEMBLING SAME

[76] Inventor: Milton H. MacDonald, Jr., 5 Holly St., Woodsville, N.H. 03785

[21] Appl. No.: 502,760

[22] Filed: Jun. 9, 1983

[51] Int. Cl.[3] ..... E04B 2/32

[52] U.S. Cl. ..... 52/309.8; 52/405; 52/410; 52/443; 52/748

[58] Field of Search ..... 52/309.11, 309.8, 309.9, 52/410, 454, 443, 344, 348, 407, 404, 479, 481, 747, 748

[56] References Cited

U.S. PATENT DOCUMENTS

| | | | |
|---|---|---|---|
| 744,185 | 11/1908 | Garvey | 52/481 |
| 1,673,118 | 6/1928 | Lawrence | 52/479 |

FOREIGN PATENT DOCUMENTS

| | | | |
|---|---|---|---|
| 2534815 | 2/1977 | Fed. Rep. of Germany | 52/309.9 |
| 2930385 | 1/1981 | Fed. Rep. of Germany | 52/404 |
| 3149533 | 9/1982 | Fed. Rep. of Germany | 52/404 |
| 131394 | 6/1978 | German Democratic Rep. | 52/481 |
| 12139 | 5/1979 | Japan | 52/309.9 |
| 7808452 | 2/1980 | Netherlands | 52/404 |

*Primary Examiner*—Henry E. Raduazo
*Assistant Examiner*—Caroline Dennison
*Attorney, Agent, or Firm*—Pearson & Pearson

[57] ABSTRACT

A building wall structure and method includes an outer row of spaced upstanding studs and a parallel, inner row of spaced, upstanding studs forming a doubled stud wall with a space between the rows. A plurality of wall insulation units are provided each unit comprising a pair of elongated, relatively thin, blocks of cellular foam plastic, one block of each pair being the mirror image of the other. Each foam block has a top face, bottom face and opposite end faces with tongue and groove configuration for sealing with juxtaposed blocks when stacked in vertical courses to fill the spaces between studs in the same row. Each block has vertical recesses in one side face for receiving the major portion of a stud with the minor portion protruding. Tie rod-spacer elements connect opposite studs. Blocks are assembled by omitting several inner wall studs, inserting the blocks and moving them along the space between the rows of studs for erection as an insulative wall between studs.

13 Claims, 8 Drawing Figures

Figure 1
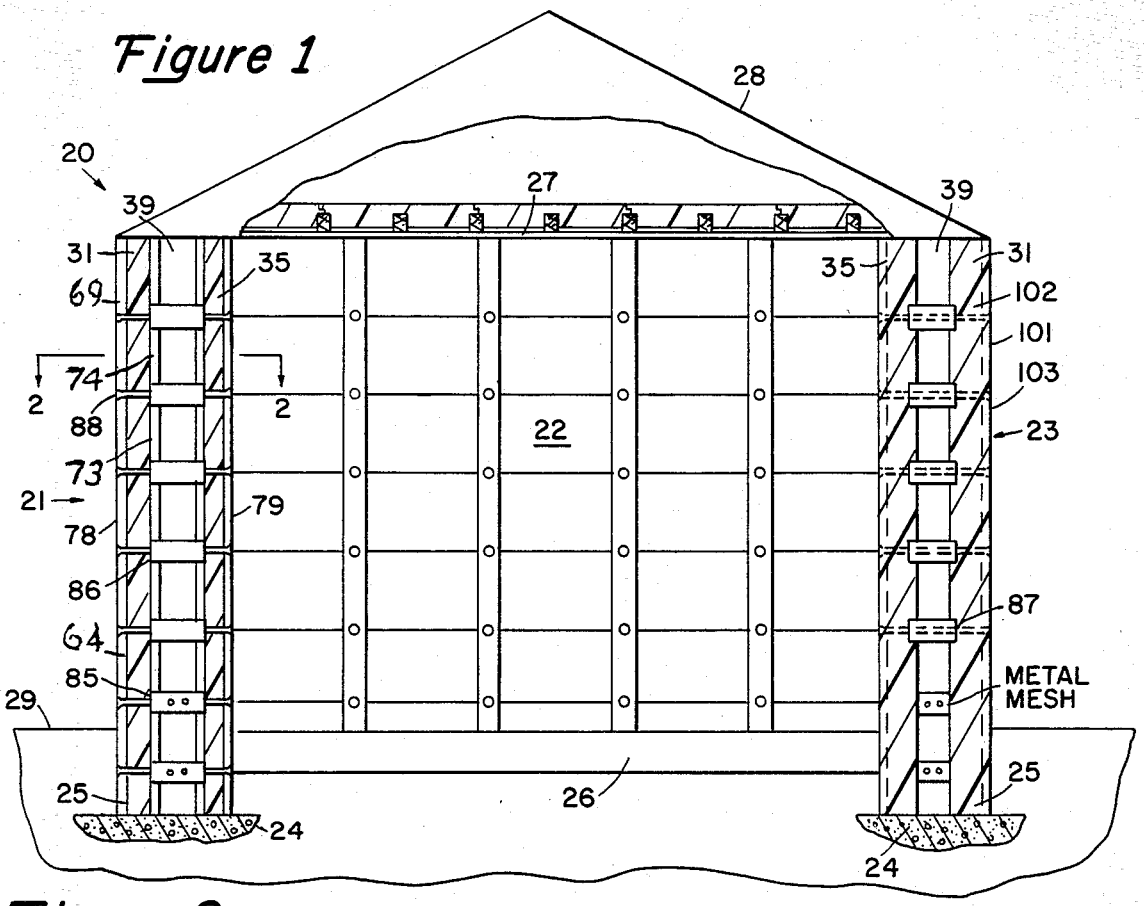
Figure 2
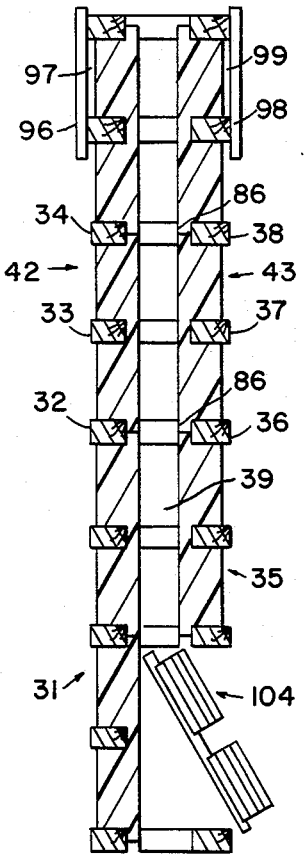
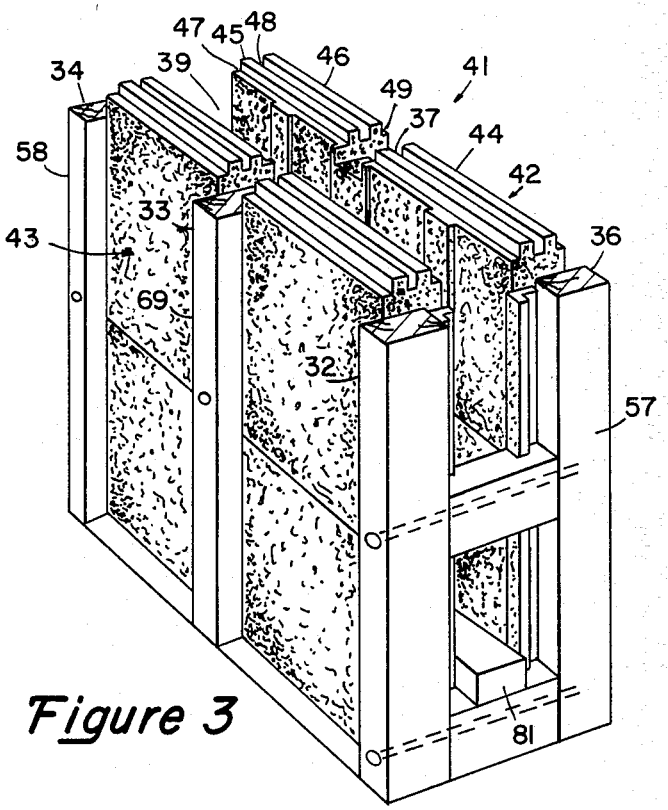
Figure 3

INSULATED BUILDING STRUCTURE AND METHOD FOR ASSEMBLING SAME

BACKGROUND OF THE INVENTION

It has long been known to use plastic foam in building blocks for insulation purposes, the blocks having tongues and/or grooves extending around the top, bottom and end faces which are for interengagement when laid in vertical courses to form a side wall.

In U.S. Pat. No. 2,683,980 to Krause of July 20, 1954 the wall is one block thick with central grooves around the block perimeter for the wood frame members which run horizontally.

A similar expedient is proposed in U.S. Pat. No. 3,220,151 of Nov. 30, 1965 to Goldman wherein a pair of foam panels come together to form a block with central vertical voids and cement is poured into the voids to form the framework.

A single block of foam plastic having tongue and groove configuration around its perimeter and central voids for receiving cement is disclosed in U.S. Pat. No. 3,410,044 to Moog of Nov. 12, 1968.

A "foam form" product of Foam-form Canada Limited, 100 Canadian Road, Scarborough, Ontario, Canada is also known. It makes use of a plurality of polystyrene foam blocks to retain poured "in place" concrete with the help of horizontal reinforcing steel. Each foam block consists of a pair of panels permanently connected by steel mesh connectors extending across a gap which receives the poured cement and each panel has tongue and groove interlock edges extending therearound.

SUMMARY OF THIS INVENTION

In this invention a polystyrene foam plastic unit is provided, which somewhat resembles the above mentioned "foam form" product in that it comprises a pair of foam blocks, each having a tongue and groove configuration therearound but unlike "foam form", the blocks of the pair are not connected.

In addition the units formed by each pair of blocks are not primarily for the purpose of retaining poured concrete but, instead are insulation fillers located between a double row of vertical wood studs which form the framework of the side wall.

Thus, instead of having cavities or recesses in the inner side wall of each block to receive cement, the blocks of this invention have cavities or recesses in the outer side walls of the blocks to receive the wood studs.

The tongue and groove configuration of the blocks of the invention is integral with the relatively wide top and bottom faces so that multiple tongues and grooves preferably with curved, corners or edges, provide a suitable heat insulation seal at the joints between blocks.

The vertical studs on the outer row of studs protrude from the recesses in the outer stack of foam blocks so that clapboards or siding can be applied horizontally, leaving an air gap for ventilation and insulation. Another air gap is provided in the space between the inner and outer row of studs for ventilation and insulation as well as to permit blocks to be inserted in an opening and moved along the gap into place. The protrusion of the inner studs from their recesses permits panelling, sheetrock, etc. to be applied thereto with an air gap behind the same.

DESCRIPTION OF THE DRAWINGS

FIG. 1 is a diagrammatic side elevation, in section, of a typical building with a side wall constructed in accordance with the invention, the tongue and groove configuration being omitted due to small scale.

FIG. 2 is a diagrammatic plan view in section on line 2—2 of FIG. 1.

FIG. 3 is an enlarged, fragmentary, perspective view of a section of the wall of the invention and showing the tongue and groove configuration of a typical pair of foam blocks.

DESCRIPTION OF A PREFERRED EMBODIMENT

Figure 4:
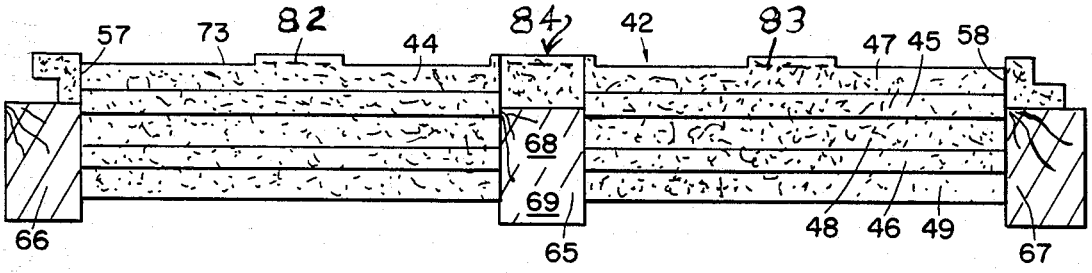
FIG. 4 is a top plan view.
Figure 5:
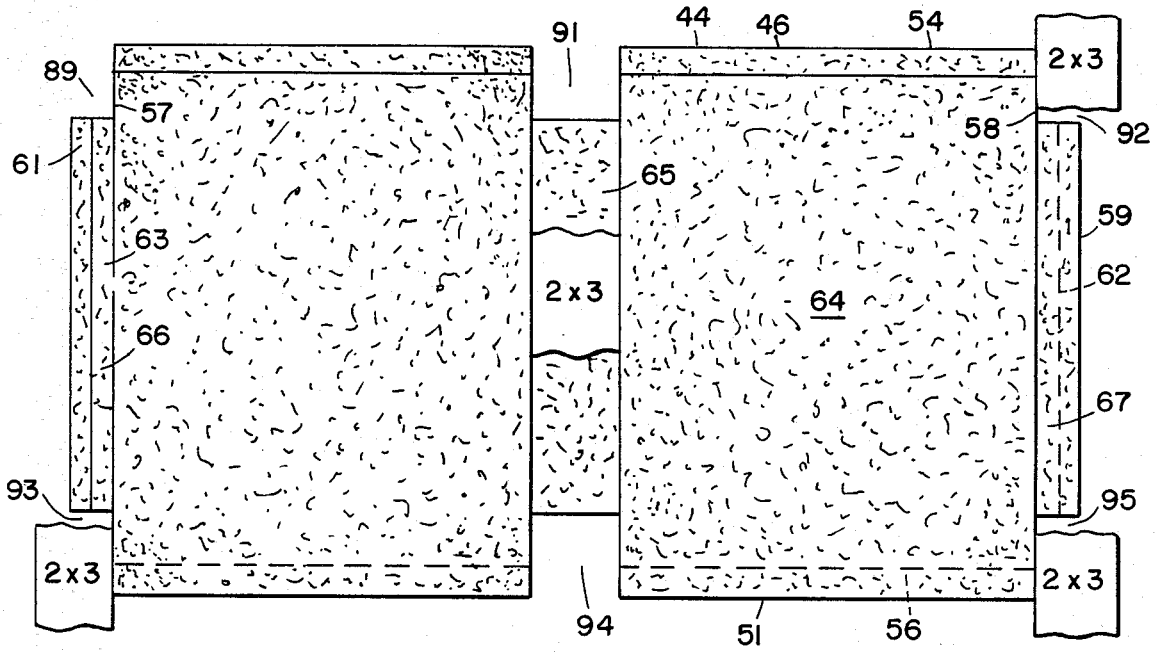
FIG. 5 is a side elevation.
Figure 6:
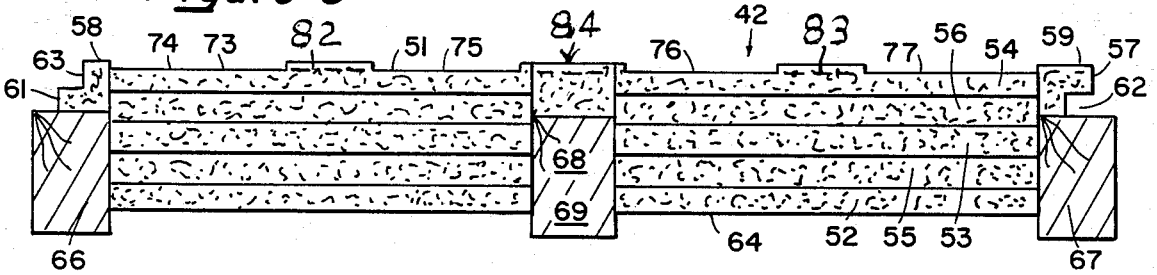
FIG. 6 a bottom plan view.
Figure 7:
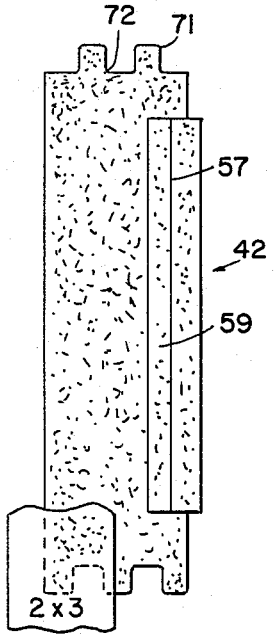
FIG. 7 a right end elevation, and FIG. 8 a left end elevation of one of the blocks of one of the pairs of blocks forming a wall insulation unit of the invention.
Figure 8:
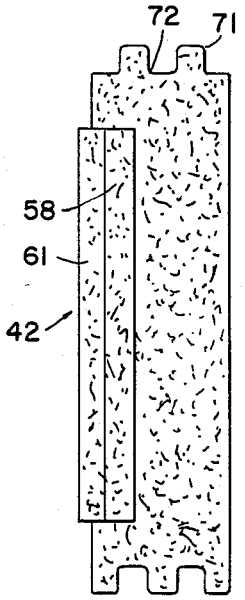

As shown in the drawings, a building 20 constructed with side walls 21, 22, and 23 in accordance with the invention, includes a footing 24, foundation 25, floor 26, ceiling 27 and roof 28, the footing being well below ground level 29.

Each side wall 21, 22, and 23 is formed by an outer set, or row 31, of vertical studs such as 32, 33, or 34, which are spaced a predetermined distance apart, such as sixteen, or twenty four inches, and which preferably are standard 2″×3″ wood studs with the narrow 2″ side out. Each side wall 21, 22, and 23 also includes an inner set, or row, 35 of vertical studs such as 36, 37, and 38 which are spaced the same distance apart as are the studs of the outer set so that each inner stud is opposite one of the outer studs. The outer set of studs 31 is spaced from the inner set of studs 35 by an air gap, or space, 39 which is about four inches in width, both sets being in parallelism as they extend along, and around, the periphery of the building 20.

A double row of studs, with a space between rows, thus forms the load carrying frame of the side walls 21, 22 and 23. Since 2×3 studs are preferred with the narrow faces out, the studs and stud space total 3″+3″+4″ or about ten inches so that they can be supported directly on top of a 12″ block foundation, or may even be supported directly on the footing as shown.

Each wall insulation unit 41 of the invention consists of a pair of independent, normally unconnected, identical plastic cellular foam blocks 42 and 43, one being the mirror image of the other. Each block 42 or 43 is preferably one piece of polystyrene foam about three inches in overall thickness, twenty eight inches in height and forty eight inches in length. Each block includes a top face 44 with two tongues 45 and 46 and three grooves 47, 48, and 49 extending longitudinally therealong, a bottom face 51 with three tongues 52, 53, and 54, and two grooves 55 and 56 extending longitudinally therealong and with opposite end faces 57 and 58 each having at least one tongue 59 and 61 and one groove 62 or 63 extending therealong.

Each block such as 42 is also provided with one side face 64, called the stud contacting face, which is provided with a central vertical recess 65 equal in width to the 2″ dimension of the studs and equal in depth to about 75% of the 3″ dimension of the studs. It is also provided with a pair of end vertical recesses 66 and 67 each equal in width to half the 2″ dimension of the studs and equal in depth to about 75% of the 3" dimension of the studs. Thus when the blocks are in position between the studs in a row, the major portion 68 of each stud is received in the recesses in the blocks but the minor portion 69 protrudes for a purpose to be explained hereinafter.

As best shown in the end elevations each block such as 42, the corner edges of the tongues and grooves are rounded as at 71 and 72 for more ready interengagement with the corresponding tongues and grooves of juxtaposed blocks when the blocks are stacked in vertical courses to form the double insulative wall shown in FIGS. 1 and 2. The rounded edges and corners also tend to prevent inadvertent breakage of the cellular foam plastic material of the blocks during sealing of the joints between the blocks by interengagement of the multiple tongues and grooves.

Each block such as 42, has its other side face 73, opposite to its outer, or stud contacting face 64, provided with a plurality of shallow, vertical vent grooves such as at 74, 75, 76 and 77 so that there will be continuous vertical air vents in the air space, or gap 39 between the outer insulative wall of blocks 78 and the inner insulative wall of blocks 79 even when the elongated strip of plastic foam 81 is laid along the gap on the tie-rod spacers at each course to back up the blocks while stuccoed or plastered. Preferably, a plurality of horizontal, shallow grooves, such as at 82 and 83, are combined with the vertical grooves 74, 75 and 76 to form a ventilation grid 84 on the inner side face 73 of each block 42 or 43 and assure ventilation if the blocks are applied against a flat wall.

As best shown in FIGS. 1 and 2 while the blocks 42 and 43 of each wall insulation unit 41 are unconnected, the studs of the outer set 31 are connected to the studs of the inner set 35 across the air space 39, preferably at each course of blocks, by combined tie rod and spacer elements 85 or 86. Elements 85 are used below ground level and up to one foot or more above ground level and consist of a channel of meshed reinforcement metal extending between inner and outer studs and a tie bolt 87 passing through the studs and channel to hold it in place while cement is poured in to the gap 39. In the remaining upper portion of the walls 21, 22 or 23 spacers 86, cut from the 2×3" stud scrap, are used to extend between each opposite pair of studs at each course with an elongated bolt 87 passing through the studs and spacer to tie the studs to each other or with screws 88 passing through each stud into an opposite end of the filler.

Each block is provided with upper, central and opposite end cut outs 89, 91 and 92 and lower central and opposite end cut outs 93, 94 and 95 for receiving the tie rod-spacer elements 85 or 86 so that they may be in contact with the material of the studs.

Normally clapboards or siding are applied horizontally to the outer faces 96 of the protruding minor portions 69 of the studs of the outer set 31, leaving an insulating air gap 97 between the clapboards and the side faces 64 of the outer insulative wall of blocks. Similarly plywood or sheetrock panels are applied to the inner faces 98 of the protruding portions 69 of the studs of the inner set 35 leaving an insulating air gap 99. However, if it is desired to stucco the exterior wall or to plaster the interior wall, a plurality of flat rectangular thin blocks such as 101, of the plastic foam material 102 of which the blocks 42 or 43 are formed is adhered, or otherwise affixed to the outer face 64 of each block to fill the air gaps 97 or 99 to present a smooth flush wall face such as at 103.

In the method of assembling the insulated wall of the invention, the outer row 31 and the inner row 35, of studs are erected with about a four inch space therebetween, and with one or two of the inner studs in the inner row omitted to form an access opening 104. The preformed blocks such as 42 are then inserted in the access opening, moved along the gap 39 and stacked in courses individually and successively to form an insulation wall between the outer studs, with the outer studs received in the vertical stud receiving recesses in the blocks and the block vertical tongue and groove joints staggered.

The inner wall blocks are then inserted individually and successively through the access opening, stud recessed side face inwardly, moved along the gap between the double row of studs and stacked in courses to form the inner insulation between the inner studs of the wall.

The access opening is then closed with the omitted studs to complete the wall.

The blocks 42 or 43 may be formed in any desired dimensions depending on the spacing desired for the upstanding studs, window and door locations, etc.

Preferably the blocks are of fireproof plastic foam material so that electric wiring laid on the elongated foam spacer strips 81 and electric switch boxes installed in hollows in the block foam material provide no opportunity for electricity caused fire within the walls. Such blocks are obtainable as "Plastifoam" from Plastifoam Corp., 66–68 West Street, Rockville, Ct. 06066.

Instead of using the thin flat rectangular blocks 101 (FIG. 1), as fillers, when plaster or stucco is to be applied, the blocks 42 and 43 can be made four inches thick rather than three inches thick. To create a change of air within the doubled insulated wall of the invention, I may provide a tube through one of the foam blocks leading from the ambient atmosphere to the space, or gap, 39 there being a screen and cap cover over the outer end, so that a vacuum cleaner or air hose can be attached when desired or for ventilation in hot weather.

By supporting the foam blocks directly on the footing, there are no sills to rot and a single set of blocks 42 can be formed into a single thickness insulative wall in existing buildings.

I claim:

1. A wall insulation unit comprising:

a pair of laterally spaced, identical, elongated, blocks of plastic cellular foam insulation material, one block in mirror relationship to the other but spaced apart therefrom by at least the thickness of a block;

each block having one side face with a central, vertical recess of predetermined width and depth and a pair of vertical recesses, each at an opposite end thereof and equal in depth to said predetermined depth and equal in width to one half the predetermined width of said central recess for receiving the major portion of the depth of vertical wall studs with the minor portions thereof protruding from said recesses and each block having a top face a bottom face and two opposite end faces, each with a tongue and groove configuration thereon adapted to mate and interengage with corresponding tongue and groove configurations of juxtaposed blocks to seal the joints therebetween;

2. A wall insulation unit as specified in claim 1 wherein:

the top face of each block has two longitudinally extending tongues separated by three longitudinally extending tongue grooves; and the bottom face of each block has three longitudinally extending tongues and two longitudinally extending tongue grooves.

3. A wall insulation unit as specified in claim 1 wherein:

each said block has its other side face with a plurality of parallel, spaced apart, vertical shallow grooves therein.

4. A wall insulation unit as specified in claim 2 wherein:

said longitudinally extending tongues and grooves on said top face and on said bottom face have the longitudinally extending edges and corners thereof curved to prevent inadvertent breakage of the foam material thereof.

5. A wall insulation unit as specified in claim 1 wherein:

each said block has its other side face with a gridlike pattern of spaced apart horizontal shallow grooves intersecting spaced apart vertical shallow grooves.

6. A wall insulation unit as specified in claim 1 wherein:

each said block includes upper central and opposite end cut-outs and lower central and opposite end cut-outs for receiving tie rod-spacer elements.

7. A building side wall comprising:

an outer set of vertical studs, spaced a predetermined distance apart; and extending along the periphery of the building;

an inner set of vertical studs extending along the periphery of said building, in parallelism with the studs of said outer set, at a spaced distance therewithin, to form a double row of spaced apart studs;

the studs of the inner set being each opposite a stud of the outer set;

a plurality of wall insulation units, each unit comprising a pair of laterally spaced, identical, elongated, blocks of plastic cellular foam insulation material;

each block of each pair having an elongated, stud contacting side face with a plurality of vertical stud receiving recesses, equal in depth to the major portion of the depth of a stud, so that a minor portion of a stud will project therefrom;

each block having a top face, a bottom face and two opposite end faces, each with a tongue and groove configuration for interengaging with the corresponding tongue and groove configuration of juxtaposed blocks for sealing the joints therebetween, one set of said pairs of blocks being assembled into an insulative outer wall in the spaces between said outer set of studs and the other set of blocks of the pairs being assembled into an insulative inner wall in the spaces between said inner set of vertical studs;

the resulting inner and outer insulated block walls being spaced apart at least a distance equal to the thickness of a block to provide an air insulation gap therebetween and to permit sliding of blocks along said space during said assembly.

8. A combination as specified in claim 7 wherein:

said building side wall includes applurality of tie rod-spacer elements each extending between a stud of the inner set and an opposite stud of the outer set at each course of said blocks and each said block includes upper and lower, central and opposite end cut outs for receiving said tie rod-spacer elements.

9. A combination as specified in claim 7 wherein:

said side wall includes a plurality of filler blocks, of said plastic foam material, adapted to fill the spaces between the protruding minor portions of said studs to form a smooth outer, or inner, wall surface for receiving outside stucco or inside plaster.

10. A combination as specified in claim 7 wherein:

said building side wall includes a plurality of longitudinally extending strips of said plastic foam material, equal in width to the width of the space between the blocks in the inner set of studs and the blocks in the outer row of studs, each said strip lying on the tie rod-spacers between said sets of studs of one of the horizontal joints between vertical courses to serve as a back up when plaster or stucco is applied to said blocks.

11. A combination as specified in Claim 8 wherein:

said tie rod spacer elements are formed of metal mesh channel with a belt therethrough from the building footing to about ground level and are formed of wood with a bolt therethrough above ground level.

12. A combination as specified in claim 7 wherein:

said studs are of 2″×3″ wood material;

said blocks are of polystyrene plastic cellular foam material;

each block is twenty eight inches high, forty eight inches long and three inches thick and the space between the inner set of studs and the outer set of studs is about four inches in width.

13. The method of constructing an insulated wall of a building by means of upstanding studs and blocks of cellular foam plastic which comprises the step of:

preforming a plurality of relatively thin, elongated blocks of said foam plastic, each with tongue and groove top, bottom and end faces, to interengage with one another, and each block with a side face having a central and opposite end vertical recesses for receiving the major depth depth of one of said studs with the minor portion projecting therefrom;

erecting said studs in an outer row and in a spaced apart, parallel, inner row to form a skeletonized double wall, while omitting at least one of said inner studs to form an access opening into the space between said rows of studs, individually and successively inserting a plurality of said blocks, recessed side face outwardly, through said opening, moving them along said space and stacking them in courses to form insulation between the outer studs seated in the vertical recesses in said blocks, then individually and successively inserting a plurality of said blocks, recessed side face inwardly, through said opening, along said space and stacking them in courses to form insulation between the inner studs seated in the vertical recesses in said blocks and then closing said access opening by erecting the omitted studs.

* * * * *